US010988281B2

(12) United States Patent
McCarthy

(10) Patent No.: US 10,988,281 B2
(45) Date of Patent: Apr. 27, 2021

(54) PARALELLOGRAM SPLITABLE RETAIL CONTAINERS

(71) Applicant: WestRock Shared Services, LLC, Norcross, GA (US)

(72) Inventor: Timothy L. McCarthy, Wilmette (AU)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 70 days.

(21) Appl. No.: 16/217,803

(22) Filed: Dec. 12, 2018

(65) Prior Publication Data

US 2019/0185201 A1 Jun. 20, 2019

Related U.S. Application Data

(60) Provisional application No. 62/607,382, filed on Dec. 19, 2017.

(51) Int. Cl.

| | |
|---|---|
| ***B65D 5/54*** | (2006.01) |
| ***B31B 50/26*** | (2017.01) |
| ***B65D 5/42*** | (2006.01) |
| ***B65D 5/16*** | (2006.01) |
| ***B65D 5/52*** | (2006.01) |

(52) U.S. Cl.

CPC ..... *B65D 5/5445* (2013.01); *B31B 50/26* (2017.08); *B65D 5/16* (2013.01); *B65D 5/4266* (2013.01); *B65D 5/52* (2013.01)

(58) Field of Classification Search

CPC .... B65D 5/029; B65D 5/2038; B65D 5/5445; B65D 5/4266; B65D 5/16; B65D 5/2047; B65D 5/52

USPC ..... 229/108, 114, 146; 206/736

See application file for complete search history.

(56) References Cited

U.S. PATENT DOCUMENTS

| | | | | | |
|---|---|---|---|---|---|
| 4,058,206 | A * | 11/1977 | Morse | B65D 5/52 | 229/241 |
| RE33,979 | E * | 6/1992 | Cortopassi | B65D 5/6626 | 206/459.1 |
| 6,510,982 | B2 * | 1/2003 | White | A47F 5/112 | 206/736 |
| 6,948,617 | B2 * | 9/2005 | Kanter | B65D 5/001 | 206/504 |
| 7,717,324 | B2 * | 5/2010 | Keefe, Jr. | B65D 5/548 | 206/736 |
| 2005/0184139 | A1 * | 8/2005 | Gasior | B65D 5/52 | 229/240 |
| 2011/0049226 | A1 * | 3/2011 | Moreau | B65D 5/5445 | 229/112 |
| 2012/0234724 | A1 * | 9/2012 | James | B65D 5/5445 | 206/774 |

(Continued)

*Primary Examiner* — Steven A. Reynolds

(74) *Attorney, Agent, or Firm* — Neil G. Cohen; John B. Swingle

(57) ABSTRACT

A blank for forming a container includes a plurality of panels connected together at fold lines configured for extending at least partially around an interior space, including a front panel, a top panel, a back panel and a bottom panel. A first back flap, a first top flap, a first front flap, and a first bottom flap are configured to form a first side panel that is parallelogram shaped. A second back flap, a second top flap, a second front flap, and a second bottom flap are configured to form a second side panel that is parallelogram shaped and is opposite the first side panel.

18 Claims, 2 Drawing Sheets

(56) References Cited

U.S. PATENT DOCUMENTS

2017/0267399 A1* 9/2017 Buscema ..... B31B 50/74
2017/0305593 A1* 10/2017 Couture ..... B31B 50/48

* cited by examiner

PARALELLOGRAM SPLITABLE RETAIL CONTAINERS

REFERENCE TO RELATED APPLICATION

This application claims the benefit of priority under 35 U.S.C. § 119(e) of U.S. provisional application Ser. No. 62/607,382 filed on Dec. 19, 2017, which is hereby incorporated by reference in its entirety.

FIELD OF THE INVENTION

The present disclosure relates to containers, and more particularly to retail ready containers.

DESCRIPTION OF RELATED ART

Retail ready containers can be used to package and ship product to retail locations. In the retail setting, such containers are converted to display the product. Some portion of the converted containers may be discarded as part of the conversion process. Consumers can access and remove product directly from the converted container, e.g., from a tray portion remaining of the container after conversion. In traditional retail ready containers, it is possible to damage product when converting the container for retail use. For example, when converting a retail ready container, if the tray portion of the container supports product only from below the center of gravity of the product, it is possible for product to fall forward out of the display portion of the container and be damaged. Care must therefore be taken when using traditional retail ready containers.

The conventional techniques have been considered satisfactory for their intended purpose. However, there is an ever present need for improved containers. This disclosure provides a solution for this need.

SUMMARY OF THE INVENTION

A blank for forming a container includes a plurality of panels connected together at fold lines configured for extending at least partially around an interior space, including a front panel, a top panel, a back panel and a bottom panel. A pair of opposed back flaps are foldably connected to opposed edges of the back panel. A pair of opposed bottom flaps are foldably connected to opposed edges of the bottom panel. A pair of opposed front flaps are foldably connected to opposed edges of the front panel. A pair of opposed top flaps are foldably connected to opposed edges of the top panel. A first one of the back flaps, a first one of the top flaps, a first one of the front flaps, and a first one of the bottom flaps are configured to form a first side panel that is parallelogram shaped. A second one of the back flaps, a second one of the top flaps, a second one of the front flaps, and a second one of the bottom flaps are configured to form a second side panel that is parallelogram shaped and is opposite the first side panel.

A tear line can be defined across the front panel for tearing the front panel to convert the container to be retail ready. The tear line can extend across each of the front flaps. The tear line can extend across each of the front flaps along a respective curve. Each of the bottom flaps can include a curved edge configured to align with the respective curve of the front flaps.

The front panel can be connected to the top panel at a fold line. The back panel can be connected to the top panel at a fold line. The bottom panel can be connected to the front panel at a fold line. A tear line can extend along an edge where the top panel and back panel meet. A handle tear line can be included in the back panel, connecting with the tear line defined along the edge where the top panel and back panel meet for gripping the top panel to convert the container to be retail ready.

An adhesive tab can extend form an edge of the bottom panel opposite the front panel. The adhesive tab can be configured to be adhered to the back panel to join the bottom panel to the back panel. The top flaps can each include an oblique edge configured to form an acute angle flush with the back panel. The bottom flaps can each include an oblique edge configured to form an acute angle flush with the front panel. The plurality of panels can include a corrugated paper board material.

A container includes a plurality of panels extending at least partially around an interior space, including a front panel connected to a top panel, a back panel connected to the top panel, and a bottom panel connected to the back panel and to the front panel. A pair of opposed back flaps are foldably connected to opposed edges of the back panel. A pair of opposed bottom flaps are foldably connected to opposed edges of the bottom panel. A pair of opposed front flaps are foldably connected to opposed edges of the front panel. A pair of opposed top flaps are foldably connected to opposed edges of the top panel. A first one of the back flaps, a first one of the top flaps, a first one of the front flaps, and a first one of the bottom flaps form a first side panel that is parallelogram shaped. A second one of the back flaps, a second one of the top flaps, a second one of the front flaps, and a second one of the bottom flaps form a second side panel that is parallelogram shaped and is opposite the first side panel.

On a first side of the interior space, a first one of the back flaps can overlap with a first one of the top flaps to form a first side joint, the first one of the top flaps can overlap with a first one of the front flaps to form a second side joint, the first one of the front flaps can overlap with a first one of the bottom flaps to form a third side joint, and the first one of the bottom flaps can overlap with the first one of the back flaps to form a fourth side joint. At least one of the side joints can include adhesive joining the respective flaps, and at least one of the side joints can be free of adhesive joining the respective flaps to facilitate conversion of the container for retail use.

On a second side of the interior space opposite the first side, a second one of the back flaps can overlap with a second one of the top flaps to form a fifth side joint, the second one of the top flaps can overlap with a second one of the front flaps to form a sixth side joint, the second one of the front flaps can overlap with a second one of the bottom flaps to form a seventh side joint, and the second one of the bottom flaps can overlap with the second one of the back flaps to form an eighth side joint. At least one of the fifth, sixth, seventh, and/or eighth side joints can include adhesive joining the respective flaps, and at least one of the fifth, sixth, seventh and/or eighth side joints can be free of adhesive joining the respective flaps to facilitate conversion of the container for retail use.

The first side joint and the fifth side joint can be free of adhesive, and the second, third, fourth, sixth, seventh, and eighth side joints can each include adhesive.

The front panel can be connected to the top panel at a fold line. The back panel can be connected to the top panel at a fold line. The bottom panel can be connected to the front panel at a fold line. A tear line can extend along an edge where the top panel and back panel meet. A handle tear line can be included in the back panel, connecting with the tear line defined along the edge where the top panel and back panel meet for gripping the top panel to convert the container to be retail ready. An adhesive tab can extend form an edge of the bottom panel opposite the front panel, wherein the adhesive tab is adhered to the back panel to join the bottom panel to the back panel.

A tear line can be defined across the front panel for tearing the front panel to convert the container to be retail ready. The tear line can extend across each of the front flaps along a respective curve, wherein each of the bottom flaps includes a curved edge aligned with the respective curve of the front flaps.

The top flaps can each include an oblique edge forming an acute angle flush with the back panel. The bottom flaps can each include an oblique edge forming an acute angle flush with the front panel.

A method of assembling a container includes forming a plurality of panels to wrap at least partially around an interior space, wherein the panels include a front panel connected to a top panel, a back panel connected to the top panel, and a bottom panel connected to the back panel and to the front panel, with a pair of opposed back flaps foldably connected to opposed edges of the back panel, a pair of opposed bottom flaps foldably connected to opposed edges of the bottom panel, a pair of opposed front flaps foldably connected to opposed edges of the front panel, and a pair of opposed top flaps foldably connected to opposed edges of the top panel. The method includes overlapping a first one of the back flaps with a first one of the top flaps to form a first side joint on a first side of the interior space, overlapping the first one of the top flaps with a first one of the front flaps to form a second side joint on the first side of the interior space, overlapping the first one of the front flaps with a first one of the bottom flaps to form a third side joint on the first side of the interior space, and overlapping the first one of the bottom flaps overlaps with the first one of the back flaps to form a fourth side joint on the first side of the interior space. The method includes adhering respective flaps of at least one of the side joints to form opposed side walls of the respective flaps, wherein the sidewalls are parallelogram shaped.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
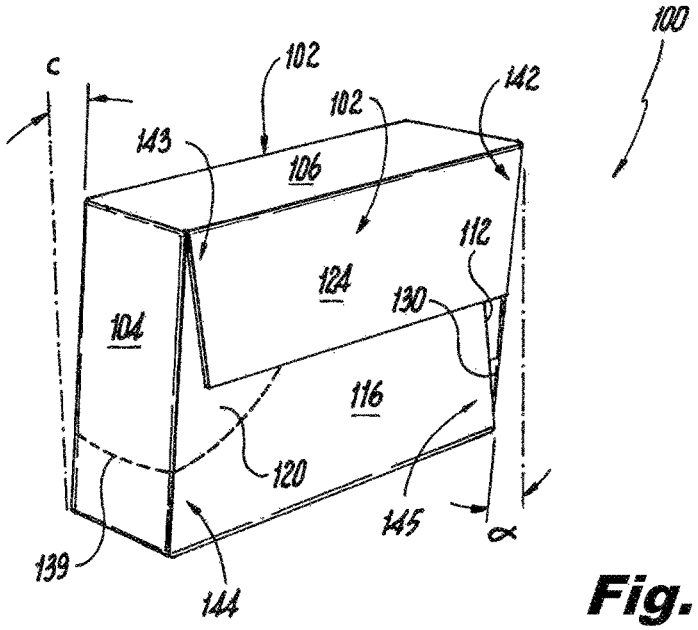
FIG. 1 is a perspective view of an exemplary embodiment of a container constructed in accordance with the present disclosure, showing the container prior to conversion for retail display.
Figure 2:
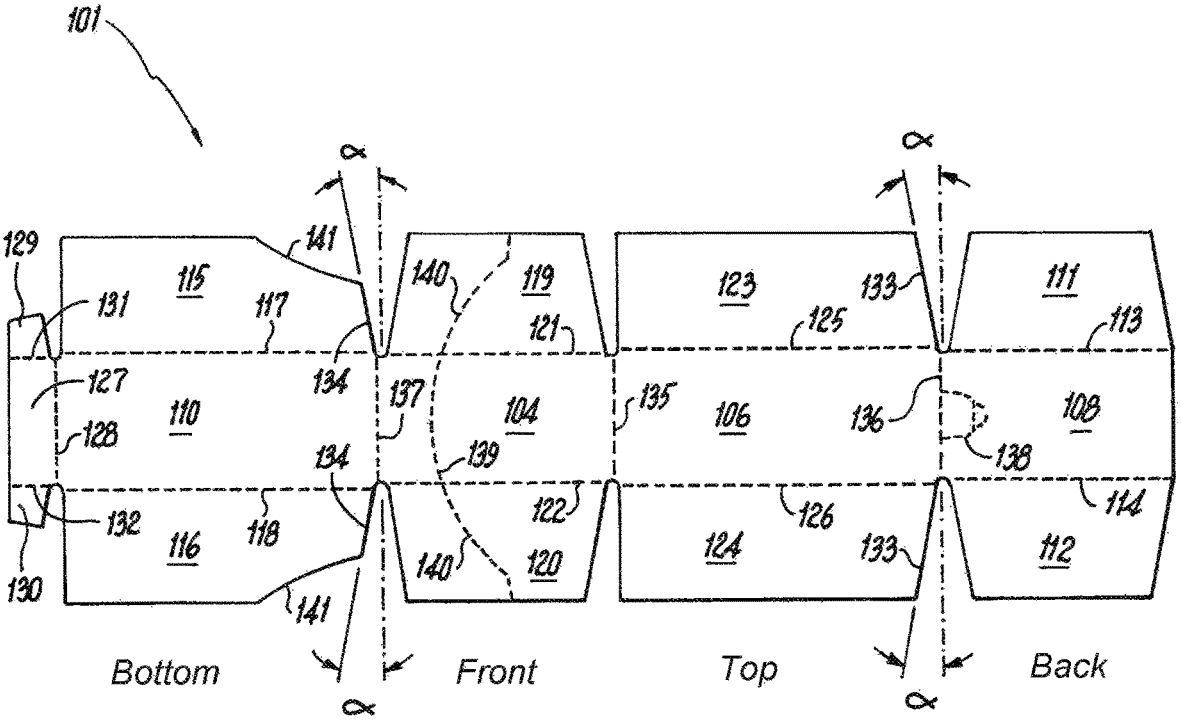
FIG. 2 is a plan view of the a blank for forming the container of FIG. 1.

Reference will now be made to the drawings wherein like reference numerals identify similar structural features or aspects of the subject disclosure. For purposes of explanation and illustration, and not limitation, a partial view of an exemplary embodiment of a container in accordance with the disclosure is shown in FIG. 1 and is designated generally by reference character 100. Other embodiments of containers in accordance with the disclosure, or aspects thereof, are provided in FIGS. 2-5, as will be described. The systems and methods described herein can be used to provide a container that converts for retail display of products while reducing loss from products falling out of the container during conversion.

The carton 100 shown in assembled form in FIG. 1 includes two side panels 102 that have a parallelogram shape giving the carton 101 a generally parallelepiped shape. The carton 100 can be formed from the blank 101 shown in FIG. 2. The blank 101 and the panels and flaps thereof can be of any suitable material such as a corrugated paper board material.

The blank 101 for forming the container 100 includes a plurality of panels connected together at fold lines configured for extending at least partially around an interior space. There is a front panel 104, a top panel 106, a back panel 108 and a bottom panel 110. A pair of opposed back flaps 111 and 112 are foldably connected to opposed edges of the back panel 108 along fold lines 113 and 114. A pair of opposed bottom flaps 115 and 116 are foldably connected to opposed edges of the bottom panel 110 along fold lines 117 and 118. A pair of opposed front flaps 119 and 120 are foldably connected to opposed edges of the front panel 104 along fold lines 121 and 122. A pair of opposed top flaps 123 and 124 are foldably connected to opposed edges of the top panel 106 along fold lines 125 and 126. The back flap 112, the top flap 124, the front flap 120, and the bottom flap 116 are configured to form a first side panel 102 that is parallelogram shaped, as shown in FIG. 1. On the opposite side panel 102, the opposite back flap 111, the opposite top flap 123, the opposite front flaps 119, and the opposite bottom flap 115 are configured to form a second side panel 102 that also parallelogram shaped, as shown in FIG. 3.

An adhesive tab 127 extends form an edge of the bottom panel 110 opposite the front panel 104 along a fold line 128. The main panel of the adhesive tab 127 can be adhered to the back panel 108 and/or the flaps 129 and 130 of the adhesive tab 127 can be folded along fold lines 131 and 132 and adhered to back flaps 111 and 112 and/or bottom flaps 115 and 116. This joins the bottom panel 110 to the back panel 108.

Figure 3:
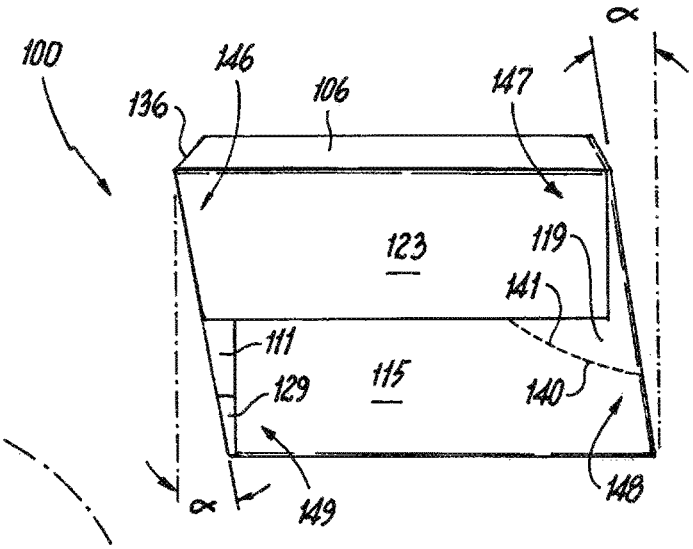
FIG. 3 is a perspective view of the container of FIG. 1, showing the opposite parallelogram side profile of the container from that shown in FIG. 1.

The top flaps 123 and 124 each include an oblique edge 133 that forms an acute angle $\alpha$ and is flush with the respective fold line 113 or 114 of the back panel 108 when the blank 101 is assembled as shown in FIGS. 1 and 3. The bottom flaps 115 and 116 each include an oblique edge 134 that forms an acute angle $\alpha$ and is flush with the respective fold line 121 or 122 of the front panel 104 when the blank 101 is assembled as shown in FIGS. 1 and 3.

The front panel 104 is connected to the top panel 106 at a fold line 135. The back panel 108 is connected to the top panel 106 at a fold line 136. The bottom panel 110 is connected to the front panel 104 at a fold line 137. The angle α of the edges 134 is oblique relative to the fold line 137 before the blank 101 is assembled. A tear line extends along the edge or fold line 136 where the top panel 106 and back panel 108 meet. The angle α for edges 133 is oblique relative to fold line 136 before the blank is assembled. A handle tear line 138 is included in the back panel 108, connecting with the tear line 136 for gripping the top panel 106 to convert the container to be retail ready.

Figure 4:
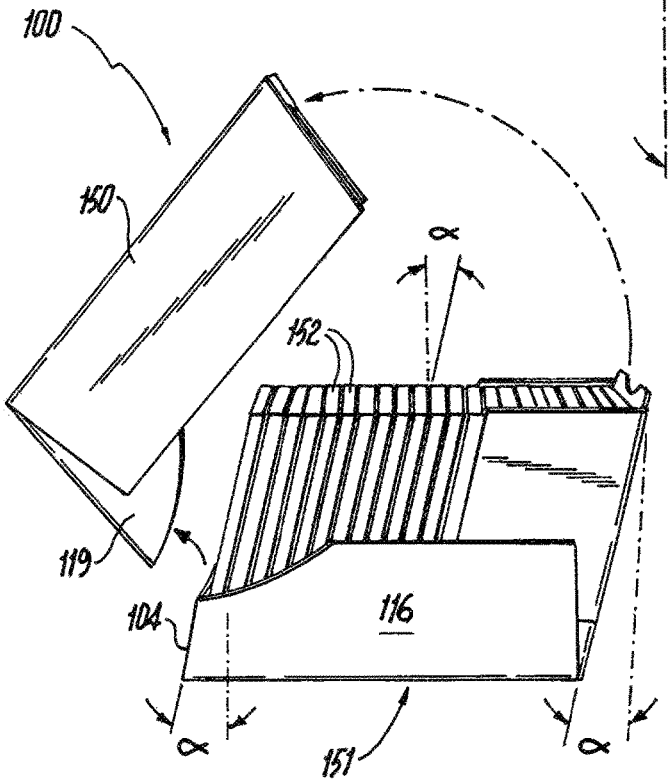
FIG. 4 is a perspective view of the container of FIG. 1, showing the removable portion of the container being removed to reveal product within the container for retail display.

A tear line 139 is defined across the front panel 104 for tearing the front panel 104 to convert the container 100 to be retail ready as shown in FIG. 4. The tear line 139 extends across each of the front flaps 119 and 120 along a respective curve 140. Each of the bottom flaps 115 and 116 includes a curved edge 141 that aligns with the respective curve 140 of the front flaps 119 and 120 when the container 100 is assembled as shown in FIGS. 1 and 3.

On a first side of the interior space, i.e., the side shown in FIG. 1, the back flap 112 overlaps with the top flap 124 to form a first side joint 142. The top flap 124 overlaps with the front flap 120 to form a second side joint 143. The front flap 120 overlaps with the bottom flap 116 to form a third side joint 144. The bottom flap 116 overlaps with the back flap 112 to form a fourth side joint 145. On a second side of the interior space opposite the first side, i.e., the side shown in FIG. 3, the back flap 111 overlaps with the top flap 123 to form a fifth side joint 146. The top flap 123 overlaps with the front flap 119 to form a sixth side joint 147. The front flap 119 overlaps with the bottom flap 115 to form a seventh side joint 148. The bottom flap 115 overlaps with the back flap 111 to form an eighth side joint 149.

Figure 5:
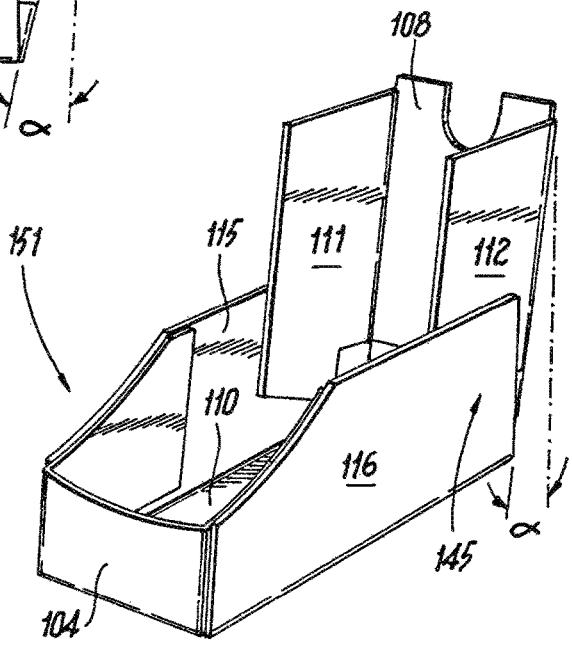
FIG. 5 is a perspective view of the display or tray portion of the container of FIG. 1, showing the display portion after removal of the removable portion and product.

The second, third, fourth, sixth, seventh, and eighth side joints 143, 144, 145, 147, 148, and 149 each include adhesive to secure the respective flaps to form the side panels 102. The first side joint 142 and the fifth side joint 146 are free of adhesive, so that when the tear lines 139 and 136 are broken, the upper portion 150 of the container 100 can be easily separated from the lower portion 151 to display product 152 in the lower portion 151 in a retail setting as shown in FIG. 4. As shown in FIG. 5, the adhesive joining flap 112 to Flap 141 at joint 145, and the adhesive joining flap 111 to flap 115 hold panel 108 at an oblique angle α relative to perpendicular. The angle α can be any suitable angle, such as 15° to 20°. This forms the side panels 102 into parallelogram shapes. This also forces the product 152, shown in FIG. 4, to lay back on the same oblique angle α. Forcing the product 152 to lay back on an oblique angle helps prevent having the product 152 fall out from the front of the container 100 when the upper portion 150 is removed for retail use.

A container 100 can be run through a case forming machine with relatively few equipment changes to standard operating settings. The blank 101 can be die cut and glued in the parallelogram shape on industry standard forming equipment. The finished container 10, with product inside, can go through a standard distribution, and can be split open at a retail location without a knife for display of the product as a shelf tray. With the product angled back, the container 100 prevents or reduces the chances of product falling forward.

The methods and systems of the present disclosure, as described above and shown in the drawings, provide for retail ready containers with superior properties including inhibiting product falling from the container during conversion for retail display of product. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for forming a container comprising:

a plurality of panels connected together at fold lines configured for extending at least partially around an interior space, including a front panel, a top panel, a back panel and a bottom panel;

a pair of opposed back flaps foldably connected to opposed edges of the back panel;

a pair of opposed bottom flaps foldably connected to opposed edges of the bottom panel;

a pair of opposed front flaps foldably connected to opposed edges of the front panel; and a pair of opposed top flaps foldably connected to opposed edges of the top panel, wherein a first one of the back flaps, a first one of the top flaps, a first one of the front flaps, and a first one of the bottom flaps are configured to form a first side panel that is non-rectangular and parallelogram shaped, and wherein a second one of the back flaps, a second one of the top flaps, a second one of the front flaps, and a second one of the bottom flaps are configured to form a second side panel that is non-rectangular and parallelogram shaped and is opposite the first side panel;

wherein a tear line is defined across the front panel for tearing the front panel to convert the container to be retail ready.

2. The blank as recited in claim 1, wherein the tear line extends across each of the front flaps.

3. The blank as recited in claim 1, wherein the front panel is connected to the top panel at a fold line, wherein the back panel is connected to the top panel at a fold line, and wherein the bottom panel is connected to the front panel at a fold line, wherein a tear line extends along an edge where the top panel and back panel meet.

4. The blank as recited in claim 3, wherein a handle tear line is included in the back panel, connecting with the tear line defined along the edge where the top panel and back panel meet for gripping the top panel to convert the container to be retail ready.

5. The blank as recited in claim 1, further comprising an adhesive tab extending form an edge of the bottom panel opposite the front panel, wherein the adhesive tab is configured to be adhered to the back panel to join the bottom panel to the back panel.

6. The blank as recited in claim 1, wherein the top flaps each include an oblique edge configured to form an acute angle flush with the back panel.

7. The blank as recited in claim 1, wherein the bottom flaps each include an oblique edge configured to form an acute angle flush with the front panel.

8. The blank as recited in claim 1, wherein the tear line extends across each of the front flaps along a respective curve, and wherein each of the bottom flaps includes a curved edge configured to align with the respective curve of the front flaps.

9. The blank as recited in claim 1, wherein the plurality of panels includes a corrugated paper board material.

10. A container comprising:

a plurality of panels extending at least partially around an interior space, including a front panel connected to a top panel, a back panel connected to the top panel, and a bottom panel connected to the back panel and to the front panel;

a pair of opposed back flaps foldably connected to opposed edges of the back panel;

a pair of opposed bottom flaps foldably connected to opposed edges of the bottom panel;

a pair of opposed front flaps foldably connected to opposed edges of the front panel; and a pair of opposed top flaps foldably connected to opposed edges of the top panel, wherein a first one of the back flaps, a first one of the top flaps, a first one of the front flaps, and a first one of the bottom flaps form a first side panel that is non-rectangular and parallelogram shaped, and wherein a second one of the back flaps, a second one of the top flaps, a second one of the front flaps, and a second one of the bottom flaps form a second side panel that is non-rectangular and parallelogram shaped and is opposite the first side panel;

wherein on a first side of the interior space, the first one of the back flaps overlaps with the first one of the top flaps to form a first side joint, the first one of the top flaps overlaps with the first one of the front flaps to form a second side joint, the first one of the front flaps overlaps with the first one of the bottom flaps to form a third side joint, and the first one of the bottom flaps overlaps with the first one of the back flaps to form a fourth side joint, wherein at least one of the side joints includes adhesive joining the respective flaps, and wherein at least one of the side joints is free of adhesive joining the respective flaps to facilitate conversion of the container for retail use;

wherein on a second side of the interior space opposite the first side, a second one of the back flaps overlaps with a second one of the top flaps to form a fifth side joint, the second one of the top flaps overlaps with a second one of the front flaps to form a sixth side joint, the second one of the front flaps overlaps with a second one of the bottom flaps to form a seventh side joint, and the second one of the bottom flaps overlaps with the second one of the back flaps to form an eighth side joint, wherein at least one of the fifth, sixth, seventh, and/or eighth side joints includes adhesive joining the respective flaps, and wherein at least one of the fifth, sixth, seventh and/or eighth side joints is free of adhesive joining the respective flaps to facilitate conversion of the container for retail use.

11. The container as recited in claim 10, wherein the first side joint and the fifth side joint are free of adhesive, and wherein the second, third, fourth, sixth, seventh, and eighth side joints each include adhesive.

12. The container as recited in claim 10, wherein the front panel is connected to the top panel at a fold line, wherein the back panel is connected to the top panel at a fold line, and wherein the bottom panel is connected to the front panel at a fold line, wherein a tear line extends along an edge where the top panel and back panel meet.

13. The container as recited in claim 12, wherein a handle tear line is included in the back panel, connecting with the tear line defined along the edge where the top panel and back panel meet for gripping the top panel to convert the container to be retail ready.

14. The container as recited in claim 10, further comprising an adhesive tab extending form an edge of the bottom panel opposite the front panel, wherein the adhesive tab is adhered to the back panel to join the bottom panel to the back panel.

15. The container as recited in claim 10, wherein the top flaps each include an oblique edge forming an acute angle flush with the back panel.

16. The container as recited in claim 10, wherein the bottom flaps each include an oblique edge forming an acute angle flush with the front panel.

17. A container comprising:

a plurality of panels extending at least partially around an interior space, including a front panel connected to a top panel, a back panel connected to the top panel, and a bottom panel connected to the back panel and to the front panel;

a pair of opposed back flaps foldably connected to opposed edges of the back panel;

a pair of opposed bottom flaps foldably connected to opposed edges of the bottom panel;

a pair of opposed front flaps foldably connected to opposed edges of the front panel; and a pair of opposed top flaps foldably connected to opposed edges of the top panel, wherein a first one of the back flaps, a first one of the top flaps, a first one of the front flaps, and a first one of the bottom flaps form a first side panel that is non-rectangular and parallelogram shaped;

wherein a second one of the back flaps, a second one of the top flaps, a second one of the front flaps, and a second one of the bottom flaps form a second side panel that is non-rectangular and parallelogram shaped and is opposite the first side panel; and wherein a tear line is defined across the front panel for tearing the front panel to convert the container to be retail ready.

18. The container as recited in claim 17, wherein the tear line extends across each of the front flaps along a respective curve, and wherein each of the bottom flaps includes a curved edge aligned with the respective curve of the front flaps.

* * * * *